US006735987B2

(12) United States Patent
Plath et al.

(10) Patent No.: US 6,735,987 B2
(45) Date of Patent: May 18, 2004

(54) CIRCULAR KNITTING MACHINE FOR THE PRODUCTION OF PLUSH FABRICS

(75) Inventors: Ernst-Dieter Plath, Albstadt (DE); Erich Bizer, Albstadt (DE)

(73) Assignee: SIPRA Patententwicklungs-und Beteiligungsgesellschaft mbH, Albstadt (DE)

( * ) Notice: Subject to any disclaimer, the term of this patent is extended or adjusted under 35 U.S.C. 154(b) by 0 days.

(21) Appl. No.: 10/367,343

(22) Filed: Feb. 14, 2003

(65) Prior Publication Data

US 2003/0154747 A1 Aug. 21, 2003

(30) Foreign Application Priority Data

Feb. 18, 2002 (DE) ..... 102 07 879

(51) Int. Cl.[7] ..... D04B 9/00
(52) U.S. Cl. ..... 66/8
(58) Field of Search ..... 66/8, 9 R, 13, 66/215, 216, 217, 219, 220, 221, 222, 57, 91, 97, 93, 104, 107, 106, 108 R

(56) References Cited

U.S. PATENT DOCUMENTS

| | | | | |
|---|---|---|---|---|
| 1,790,832 A | | 2/1931 | O'Lena | |
| 2,710,527 A | | 6/1955 | Radin | |
| 4,612,784 A | * | 9/1986 | Plath | 66/9 R |
| 5,186,025 A | * | 2/1993 | Neher | 66/9 R |
| 5,279,133 A | * | 1/1994 | Plath | 66/9 R |
| 5,791,162 A | * | 8/1998 | Plath | 66/92 |
| 5,931,025 A | * | 8/1999 | Lonati et al. | 66/217 |
| 6,128,930 A | * | 10/2000 | Schmidt | 66/92 |
| 6,269,665 B1 | * | 8/2001 | Wang | 66/91 |
| 6,321,575 B1 | * | 11/2001 | Sangiacomo | 66/93 |

FOREIGN PATENT DOCUMENTS

| | | |
|---|---|---|
| DE | 30 24 705 A1 | 1/1982 |
| DE | 31 45 307 A1 | 6/1983 |
| DE | 37 12 673 C1 | 8/1988 |
| DE | 39 27 815 A1 | 2/1991 |
| DE | 197 07 053 A1 | 8/1998 |
| EP | 0 752 490 A | 1/1997 |
| EP | 0 629 727 B1 | 12/1998 |
| GB | 1 104 859 | 3/1968 |
| GB | 2 322 387 A | 8/1998 |

* cited by examiner

*Primary Examiner*—Danny Worrell
(74) *Attorney, Agent, or Firm*—Michael J. Striker

(57) ABSTRACT

The invention relates to a circular knitting machine with knitting needles (4) and sinkers (25) for the production of plush fabrics. Each of a plurality of knitting systems has a means (71) for controlling the knitting needles (4) into a knock-over position and pattern devices arranged in front of this means (71). According to the invention, a first pattern device provided with a ground-thread guide (38) serves for selectively controlling the knitting needles (4) into a knitting or tucking position intended for the pick-up of ground thread (39) or a non-knitting position intended for the non-pick-up of ground thread (39). A second pattern device provided with a plush-thread guide (40) serves for selectively controlling the knitting needles (4) into a pick-up position intended for the pick-up of plush thread (41) or an intermediate position intended for the non-pick-up of plush thread (41). A third pattern device serves for selectively controlling the sinkers (25) at least into a first position intended for the formation of shorter plush-thread loops or a second position intended for the formation of longer plush-thread loops (FIG. 5).

11 Claims, 9 Drawing Sheets

CIRCULAR KNITTING MACHINE FOR THE PRODUCTION OF PLUSH FABRICS

TECHNICAL FIELD

The invention relates to a circular knitting machine for the production of plush fabrics which have a ground knit produced from ground threads and plush threads tied into said ground knit and comprising a needle cylinder with knitting needles intended for stitch formation, a sinker ring with sinkers intended for the formation of plush-thread loops, and a plurality of knitting systems, each with a means for controlling the knitting needles into a knock-over position after the pick-up of ground and/or plush thread.

BACKGROUND OF THE INVENTION

Numerous embodiments of circular knitting machines for the production of plush fabrics are known. They have, as a rule, a needle cylinder provided with knitting needles and a sinker ring provided with sinkers. The plush fabrics obtained by them consist of what may be referred to as a ground knit, which is usually a fabric produced with a special ground thread and by the right/left or plain type of knitting, and of plush threads tied into the ground knit.

In plush fabrics of this type, pattern effects may be achieved, in particular, in that differently coloured plush threads are used or the plush threads are processed into plush loops of different length. The patternings mentioned first are designated as coloured patternings and the others as structural patternings.

To achieve coloured patterns, for example, circular knitting machines of the generic type designated in the introduction are known (DE 31 45 307 A1), in which first a ground thread and then, according to the pattern, one of a plurality of differently coloured plush threads can be inserted into all the knitting needles accommodated in the needle cylinder.

A particularly full and dense plush fabric is thereby obtained. A particular feature which, as a rule, is undesirable in coloured patternings of this type is due to the fact that floats occur wherever the plush threads are not inserted into the knitting needles. If floats of this kind extend over more than a few stitch wales, they disturb the visual appearance of the fabric. They are therefore eliminated by means of a shearing operation carried out after the knitting operation, the result of this, moreover, being that the plush loops formed are automatically cut open. The same applies correspondingly when plush fabrics having coloured patterns are produced by the plush threads being tied in partial rows into the ground knit, that is to say when in each stitch row, according to the pattern, only plush threads of a single colour are processed into stitches and laid in a floating manner therebetween, so that less full and dense plush surfaces are obtained. Consequently, all the plush fabrics described have, as a rule, what may be referred to as a velours surface, that is to say, when this knitting technique is employed, it is not possible to produce plush fabrics which have terry cloth surfaces provided with uncut plush loops.

One advantage of the type of knitting described is that it can also be used for the production of structural or high/low patterns. For this purpose, floats are formed in selected regions of a knit by means of all the plush threads which occur, so that, after the shearing operation, only the ground knit remains in these regions and is visually apparent (DE 39 27 815 A1, DE 197 07 053 A1). The formation of floats is in this case the equivalent to formation of loop-free zones or to a selection "no plush loops". The plush fabrics produced in this way, moreover, may be provided to a restricted extent with a coloured or knitted pattern by means of the additional insertion of float threads or further ground threads.

Coloured and structural patternings may, in principle, also be produced by means of other known circular knitting machines of the generic type designated in the introduction. For example, it is known (U.S. Pat. No. 2,710,527) to feed ground threads only to those knitting needles into which a plush thread is also inserted according to the pattern such that coloured patternings can be produced, in principle, only with the aid of partial rows. In plush fabrics produced in this way, therefore, the ground threads also float in the regions free of plush threads, in addition to the plush threads, which, on the one hand, may lead to a visually ugly appearance and to undesirable material properties and, on the other hand, entails the risk that, during the shearing operation, the ground-thread floats are also removed together with the plush-thread floats. To avoid this disadvantage, circular knitting machines are known (DE 30 24 705 A1) which serve the purpose oft when relatively long ground-thread floats occur, of controlling some selected needles into a knitting or tucking position, in order thereby to process the ground thread in the region of the floats partially into a stitch or to anchor it as a tuck stitch in the ground knit. Since the floating ground thread is tied into the ground knit at only a few points, there is at the same time the advantage that the number of tie-in points is kept low and no ugly bare gaps occur during the production of coloured patternings by means of partial rows. In addition, although it is also possible to provide comparatively wide regions in the plush fabric which have no plush loops at all, nevertheless, in this type of knitting, the main preoccupation is always to avoid long ground-fabric floats in regions having plush loops.

The circular knitting machines described hitherto are therefore all used, in particular, for the production of plush fabrics with coloured patternings. Existing pattern devices for the independent individual selection of knitting needles serve in this case merely for the purpose of separating those knitting needles which are to pick up a plush thread from the remaining knitting needles. By contrast, for all other patternings, in particular for high/low patterns in plush-thread regions or for knitted patterns in ground-thread regions, only cam parts are available which act on pattern butts, assigned to them, on knitting needles or on jacks assigned to these, so that the patterning possibilities are in this respect highly limited. This would in no way be changed even by the use of interchangeable cam parts which allow patternings, such as, for example, 1:1 tuck/float or 1:1 knit/float, and which are exchanged, as required.

A hitherto unavoidable problem of the circular knitting machines described is that the selection "no plush loops" is possible only by the production of floats and the subsequent elimination of the floats by shearing. Consequently, knitted fabrics produced on these circular knitting machines, in so far as they are provided with structural patterns, always contain regions with stitches formed from ground and plush threads and regions with stitches formed solely from ground threads. In this case, in the regions free of plush threads, it is only the ground threads which determine the appearance of the plush fabric.

To avoid these properties which are not always desirable, circular knitting machines are known (U.S. Pat. No. 1,790,832, GB 1,104,859) which have pattern devices for selecting the sinkers and partially also additional pattern devices for selecting the knitting needles picking up the plush threads. The sinkers can in this case be controlled, according to the pattern, at least into a first position, in which plush loops are formed by means of a lower-lying sinker edge, or into a second position, in which plush loops are formed by means of a higher-lying sinker edge. The lower-lying sinker edges usually correspond in this case to those with which the ground-thread stitches are produced or looped. The plush loops produced by means of the lower sinker edges may in these cases also be designated as "neutral loops" or no loops". By these are meant, within the scope of the present invention, plush-thread loops which have essentially the same length as the ground-thread loops or legs and therefore, in the finished knit, lead to double stitches consisting of ground and plush threads, but do not appear as plush loops projecting beyond the ground knit. This affords the advantage that the selection "no plush-thread loops" can be implemented by controlling the sinkers into the position intended for forming the shorter loops or the "neutral loops" and the plush threads are processed in the regions free of plush loops, in the same way as the ground threads, so as to obtain smooth right/left or plain surfaces which, with correct plating, have the colour of the respective plush thread. The properties of the zones free of plush threads are therefore determined predominantly here by the plush threads, this being advantageous in some patternings.

Circular knitting machines of this type, set up mainly for the production of plush fabrics with structural patterns, have the disadvantage that, in practice, no coloured patternings can be produced and, despite the use of pattern devices in the form of pattern wheels or the like, the possibilities of structural patterning are limited. Moreover, the knitting needles can be controlled only selectively into one of two positions provided (knitting and non-knitting position), so that the ground knit can be provided at most with simple float/stitch patterns. The same applies, in principle, to circular knitting machines likewise already known, in which the sinkers can not only be brought into three positions, in order to form middle, high or no plush loops according to the pattern, but to which are also assigned interchangeable cam parts, in order to allow patternings selectively in the knit/float, knit/tuck or tuck/float types of knitting.

Finally, circular knitting machines are known (EP 0 629 727 B1), which are to make it possible to have both coloured patternings by the selection of the knitting needles according to a pattern and structural patternings by the selection of the sinkers according to a pattern, in order thereby to produce a plush knit which, in the same stitch row, possesses not only differently coloured plush loops, but also plush loops of different height. If, in a subsequent shearing operation, only the long plush loops are cut open and the plush-thread floats formed on the high sinker edges are removed, plush knits will then be obtained which have velours-like surfaces with high cut plush loops and terry-like surfaces with uncut plush loops of lesser height. It must be doubted, however, that this known method actually functions, since, for example, it is not clear how, with one and the same sinker control and in the same knitting system, differently coloured plush threads can be processed selectively into long or short plush loops and/or how floats are to be treated which are laid via sinker edges provided for short plus-thread loops. Moreover, such a circular knitting machine does not readily provide regions in a knitted fabric which are completely free of plush loops.

SUMMARY OF THE INVENTION

In view of the above it is a main object of this invention to design a knitting machine for the production of plush fabrics in such a manner that impoved patterning is possible.

A further object of this invention is to design a knitting machine for the production of plush fabrics in such a manner, that various knitted, colored and structural patterns can be produced.

Yet a further object is to provide plush fabrics having regions with plush threads and ground threads and regions only with ground thread by using one and the same knitting machine without a need for changing cam parts.

A further object underlying this invention is to design the circular knitting machine described above such that plush fabrics can be produced with various patterns both in fabric regions comprising plush threads and ground thread as well as in regions only comprising ground thread.

Further, an important object of this invention is to design the circular knitting machine identified above in such a manner that plush fabrics having long and short plush loops can be produced and that that short plush loops can be made by using different techniques.

The invention solves these and other objects by suggesting a circular knitting machine substantially as described above and having knitting systems with means for controlling the knitting needles into a knock-over position after the pick-up of ground and/or plush thread, said machine being characterized in accordance with this invention in that each of these knitting systems has, at a point located in front of the means, in the knitting direction, a first pattern device, provided with a ground-thread guide, for selectively controlling the knitting needles into a knitting or tucking position intended for the pick-up of ground thread or a non-knitting position intended for the non-pick-up of ground thread, a second pattern device, provided with a plush-thread guide, for selectively controlling the knitting needles into a pick-up position intended for the pick-up of plush thread or an intermediate position intended for the non-pick-up of plush thread, and a third pattern device for selectively controlling the sinkers at least into a first position intended for the formation of shorter plush-thread loops or a second position intended for the formation of longer plush-thread loops.

The invention for the first time affords the possibility of fully utilizing the advantages of patterning by needle control and the advantages of patterning by sinker control in one and the same circular knitting machines for the production of plush fabrics. It is thereby possible, in particular, to combine, virtually as desired, coloured and/or structural and/or knitted patterns in plush fabrics which have regions provided with plush loops and regions free of plush loops. If, according to a particularly preferred exemplary embodiment of the invention, the shorter plush-thread loops are formed via the same sinker edges as the ground-thread stitches, it is possible, moreover, to produce regions free of plush loops selectively by the formation of plush-thread floats or a subsequent shearing operation or by controlling the sinkers into the position provided for forming the shorter or neutral plush-thread loops. As a result, the visal impression of a ground-fabric portion located between two plush regions can be determined selectively by the coloured and/or knitted pattern of the ground thread or by the coloured and/or knitted pattern of the "neutral sinker loops" covering the round threads, with the result that numerous new patternings are possible. The fact that, on each knitting system, only a single plush thread can be fed and the production of partial rows is therefore necessary for coloured patternings does not constitute an appreciable disadvantage in view of the multiple patterning possibilities.

Further advantageous features of the invention may be gathered from the subclaims.

BRIEF DESCRIPTION OF THE DRAWINGS

The invention is explained in more detail below by the exemplary embodiment in conjunction with the accompanying drawings in which.

DETAILED DESCRIPTION OF THE INVENTION

Figure 1:
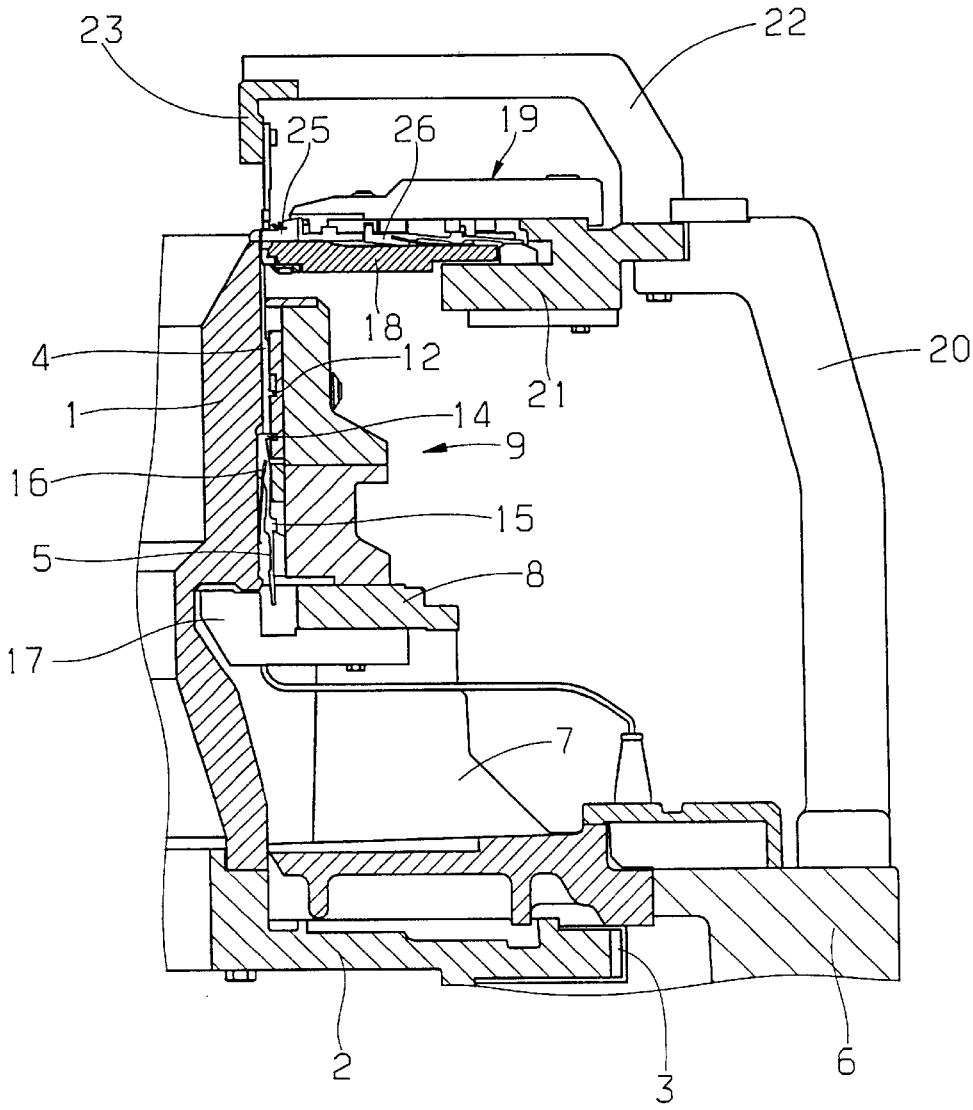
FIG. 1 shows a vertical section through a circular knitting machine according to the invention.

FIG. 1 shows an exemplary embodiment, considered to be best at the present time, of a circular knitting machine according to the invention for the production of plush fabrics, only the parts of the circular knitting machine which are necessary for understanding the invention being illustrated in the drawings and explained below in order to simplify the illustration. The circular knitting machine contains a needle cylinder 1 which is supported in a machine stand, not illustrated in any more detail, on a carrying ring 2 and which is arranged with its axis coaxially to an in this case vertical machine axis, not illustrated. In the exemplary embodiment, the carrying ring 2 is mounted, together with the needle cylinder 1, totatably about the machine axis in the machine stand and, for this purpose, is provided with an outer toothed rim 3 which is in engagement with a drive pinion, not illustrated, which can be set in rotation by a drive motor of the circular knitting machine. The needle cylinder 1 has, on its circumference, axially parallel grooves, in which are mounted knitting needles 4, in particular conventional latch needles, and selection pushers or jacks 5 which are arranged below these, both being capable of being moved up and down parallel to the vertical machine axis.

A carrier 8 for a stationary cam box 9 surrounding the needle cylinder is arranged by means of a mounting 7 on a fixed carrying ring 6, on which the carrying ring 2 may also be mounted rotatably. Cam parts, explained in more detail further below, which face the needle cylinder 1 are fastened to the cam box 9 and cooperate with radially outward-projecting butts 12, 14 and 15 of the knitting needles 4 or selection jacks 5. In this case, the selection jacks 5 are prestressed radially outwards with the aid of springs 16 supported on the bottom of the needle-cylinder grooves, in such a way that the butts 15 of the said selection pushers normally project out of the associated groove and, during the rotation of the needle cylinder 1, are raised by an associated cam part, with the result that the knitting needles 4 located directly above the selection jacks 5 are driven out, for example, into a knitting position. Moreover, below the selection jacks 5 are arranged selection devices 17 which are arranged along on the circumference of the needle cylinder 1, are fastened to the carrier 8 and have, for example, electromagnets or the like and cam parts assigned to these, by means of which the jacks 5 can be held, counter to the forces of the springs 16, in positions such that the butts 15 of the said jacks are arranged within the associated grooves and therefore, when moving past the associated cam part, are not raised by the latter, so that the associated knitting needles 4 remain, for example, in a non-knitting or circular-running position.

Circular knitting machines of this type and their selection devices 17 are generally known (for example, DE 37 12 673 C1) and therefore do not need to be explained in more detail.

Figure 2:
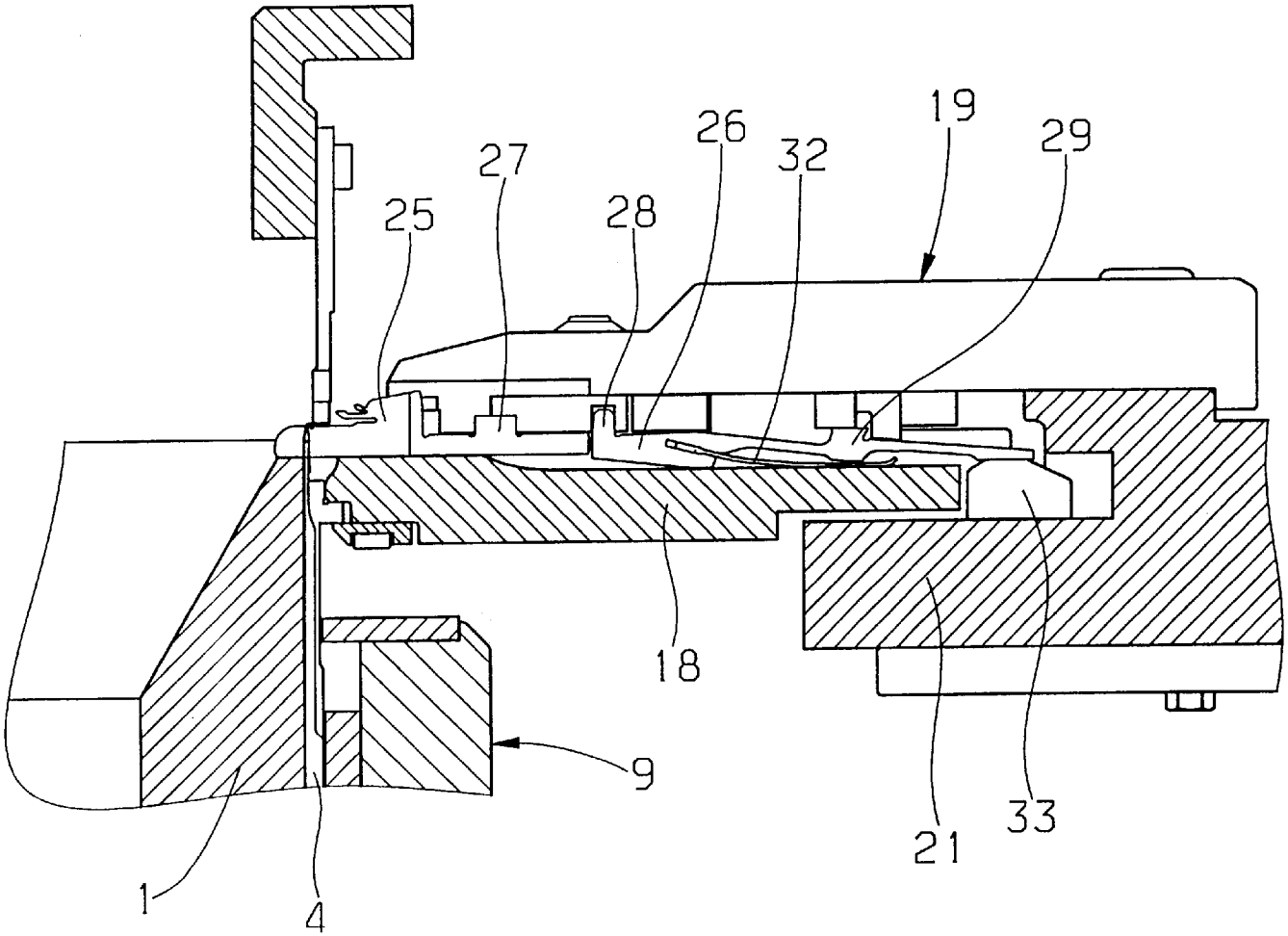
FIG. 2 shows an enlarged illustration of the circular knitting machine according to FIG. 1 in the region of a sinker ring.

According to FIGS. 1 and 2, above the needle cylinder 1, a disc-shaped sinker ring 18 capable of being set in rotation about the machine axis is mounted rotatably in the machine stand. Above the sinker ring 18 is provided an annular but stationary sinker cam 19 which is assigned to ring 18 and which is fastened to a carrier 21 supported on the carrying ring 6 with the aid of mountings 20. Moreover, the mountings 20 have fastened to them a carrier 22 carrying a thread guide ring 23, from which thread guides explained further below hang down. By means of these thread guides, those knitting needles 4 which are brought into a raised position with the aid of the selection jacks 5 can be fed with threads in a way known per se, as explained in more detail further below.

The sinker ring 18 has, on its upper side facing the sinker cam 19, radial slots or grooves, in which sinkers 25 are mounted radially displaceably. In the circular knitting machine according to the invention, as can best be seen from FIG. 2, selection jacks 26 are assigned to the sinkers 25. The jacks 26 are arranged in the same slots of the sinker ring 18 as the sinkers 25 and, in relation to the machine axis, at a point located radially further outwards. The sinkers 25 and selection jacks 26 are provided with upwardly projecting butts 27, 28 and 29. Cam parts, explained in more detail further below are assigned to these butts, fastened to the sinker cam 19 and facing the said butts, in order to generate the to and fro movements of the sinkers 25 necessary during the knitting operation, so that the sinkers 25 can cooperate with the knitting needles 4 in a way known per se. Moreover, the selection jacks 26, like the selection jacks 5 (FIG. 1), are mounted pivotably in the grooves of the sinker ring 18 and are prestressed outwards (here upwards) with the aid of springs 32 supported on the bottom of these grooves, in such a way that the butts 29 of these selection jacks 26 normally project from the slots of the sinker ring 18 and are then grasped by the associated cam parts, in order to push the sinkers 25 radially forwards in the direction of the needle-cylinder axis.

At a point arranged radially behind the sinker ring 18 are arranged, distributed on the circumference of the latter, selection devices 33 in the form of electromagnets, cam parts or the like, by means of which the selection jacks 26 can be controlled in such a way that their butts 29 project selectively upwards from the slots of the sinker ring 18 and are arranged in the effective range of the associated cam parts 4 or retracted into the slots counter to the force of the springs 32 and are thereby arranged outside the effective range of the cam parts. The mode of action of the selection jacks 26 and selection devices 33 substantially corresponds to the mode of action of the selection jacks 5 and selection devices 17 according to FIG. 1.

Figure 3:
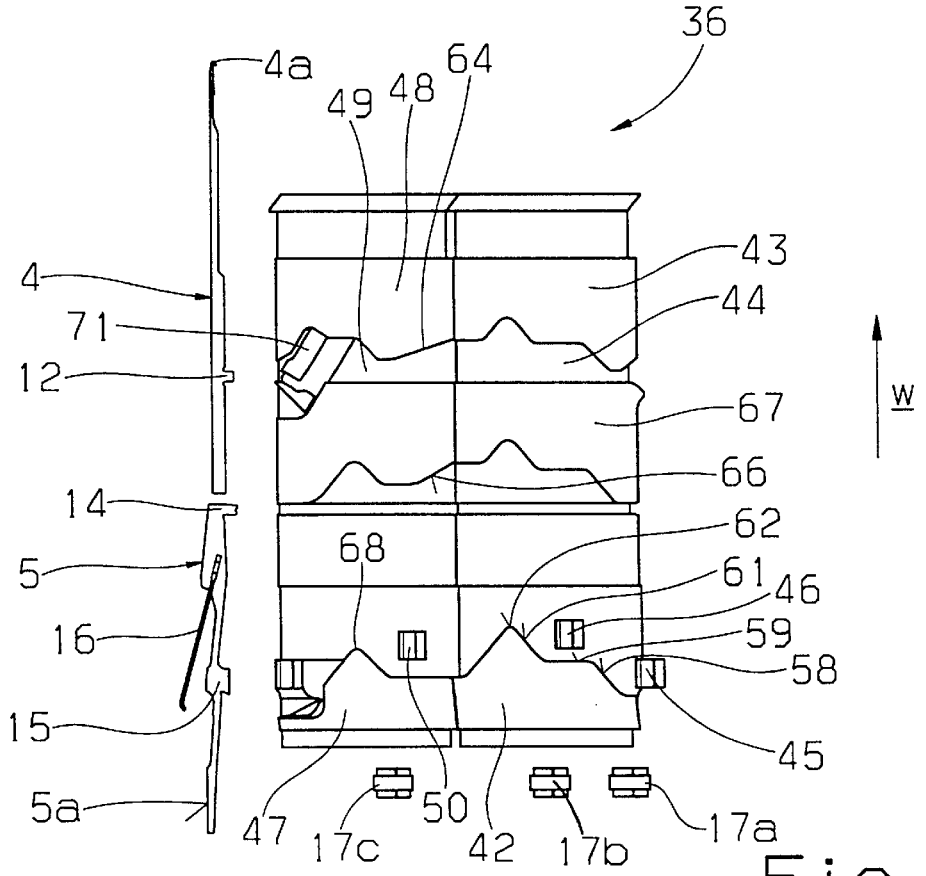
FIGS. 3 and 4 show internal views in each case of a cylinder or sinker-cam portion assigned to a knitting system, with associated needle and sinker tracks.
Figure 4:
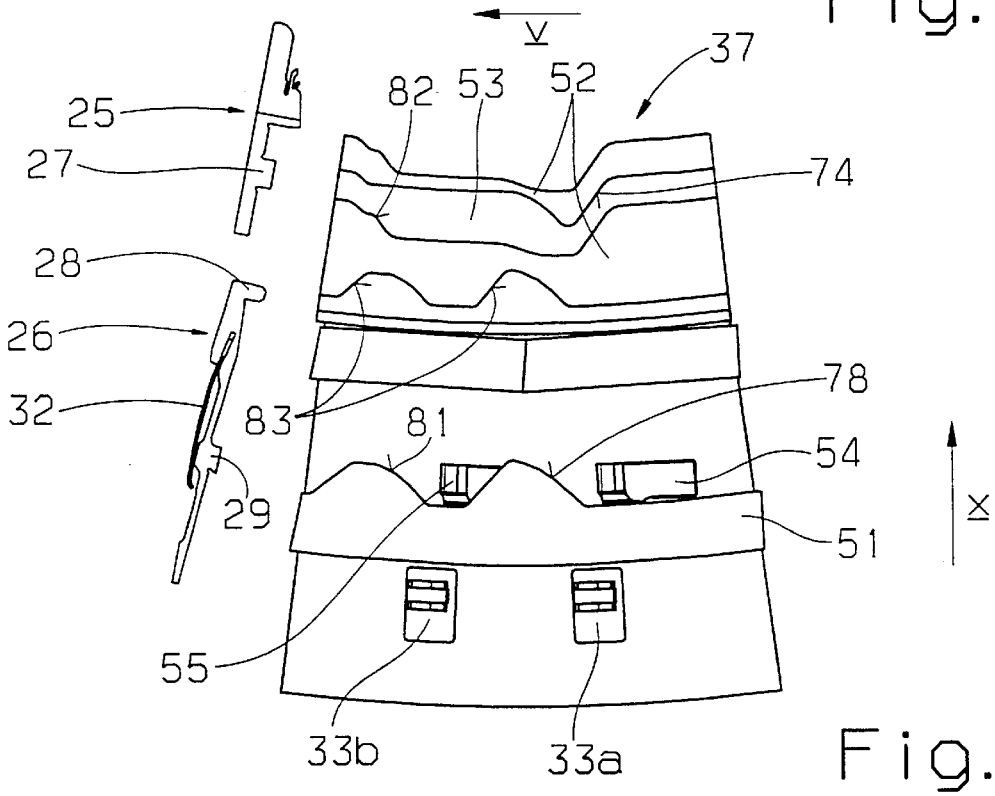

FIGS. 3 and 4 show a knitting system of the circular knitting machine according to the invention on a scale somewhat enlarged in relation to FIGS. 1 and 2. The knitting system contains two cam portions 36 and 37. It is clear, in this case, that a multiplicity of, for example, twenty-four knitting systems of this type may be arranged on the circumference of the circular knitting machine. Since all the systems are preferably designed identically, only one system of this type is described below.

FIG. 3 illustrates diagrammatically the cam-part portion 36 with its inside facing radially to the left side in FIG. 1 and FIG. 4 illustrates diagrammatically the Cam-part portion 37 with its inside facing to the bottom side in FIGS. 1 and 2. An arrow v in this case indicates the direction of rotation of the needle cylinder and sinker ring 18 or the running direction of the needles 4, sinkers 25 and selection jacks 5, 26 which, moreover, are in each case illustrated in a side view in the left-hand part of FIGS. 3 and 4. An arrow w shows the direction in which the needles 4 and jacks 5 can be raised or driven out, whilst an arrow x indicates that direction in which the sinkers 25 and jacks 26 are pushed radially forwards in the direction of the needle-cylinder axis.

Figure 5:
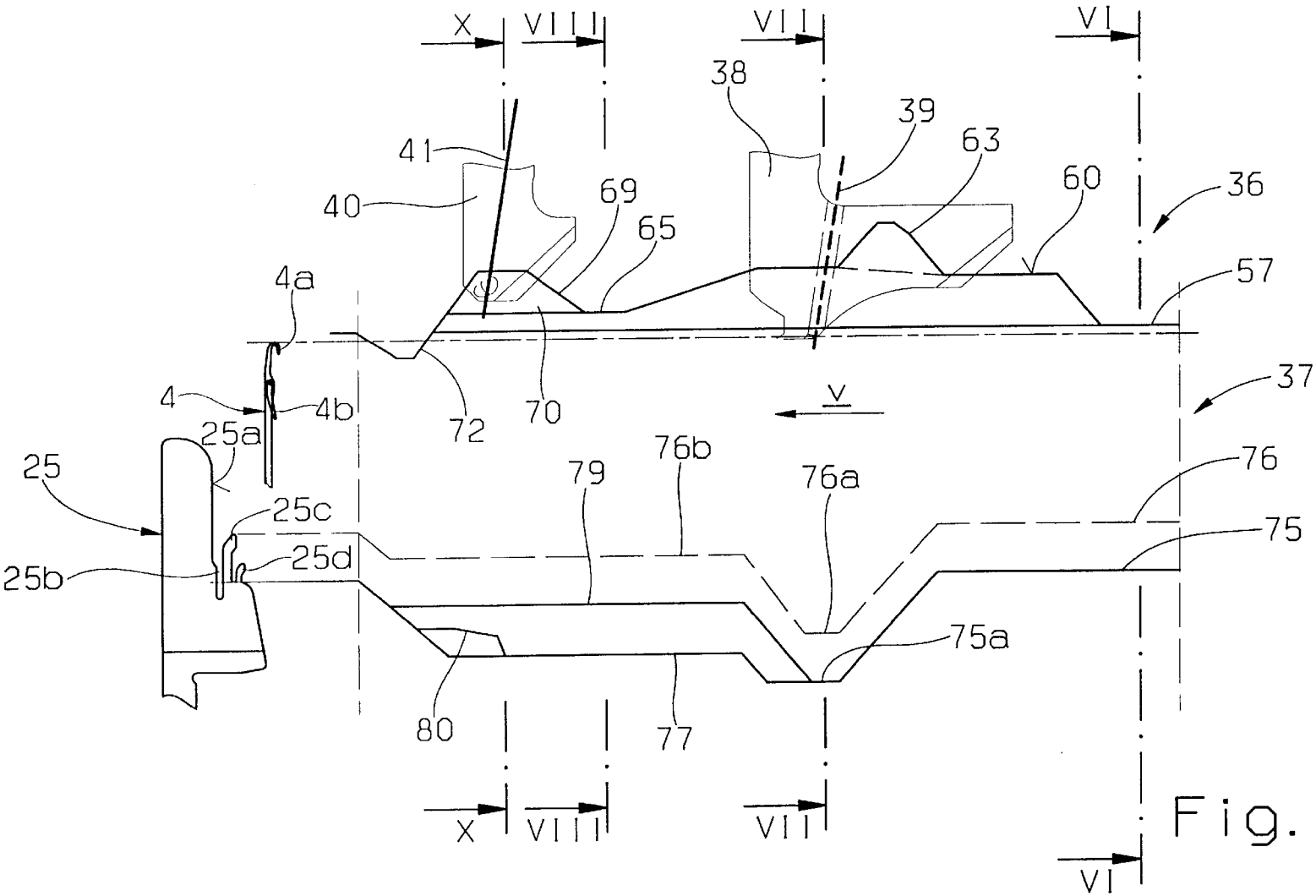
FIG. 5 shows an enlarged diagrammatic illustration of the patternings capable of being produced by means of a complete knitting system of the circular knitting machine according to FIGS. 1 to 4.

The knitting needles 4 are, for example, conventional latch needles with hooks 4*a* and latches 4*b* evident from FIG. 5, whilst the sinkers 25 act as knock-over, hold-down and plush sinkers. As shown, for example, in FIGS. 6 and 7, the sinkers 25, on the one hand, each have a knock-over edge 25*a* and hold-down throat 25*b* which are conventional in knock-over and hold-down sinkers. On the other hand, the sinkers 25 are provided with two plush-forming edges 25*c* and 25*d* arranged one above the other and above the knock-over edge 25*a,* the higher-lying plush-forming edge 25*d* being set back somewhat in the direction of the butt 27 of the sinker 25, as FIG. 7 clearly shows. The plush-forming edges 25*c*, 25*d* are preferably designed as the upper edges of noses which are formed on the sinkers 25 and project forwards from these. To illustrate the various tracks, along which the knitting needles 4 and the sinkers 25 can be moved in the region of the cam portions 36, 37, FIG. 5 illustrates in each case lines, along which the hooks 4*a* of the needles 4 or the high plush edges 25*d* of the sinkers 25 are moved. Moreover, in FIG. 5, the reference symbol 38 indicates a ground-thread guide intended for feeding a ground thread 39 and the reference symbol 40 indicates a plush-thread guide intended for feeding a plush thread 41, the two thread guides 38, 40 being fastened to the thread guide ring 23 illustrated in FIG. 1.

According to FIGS. 3 and 5, a knitting system 2 contains pattern devices which are assigned to the knitting needles 4 and selection jacks 5 and lie one behind the other in the running direction v and which are assigned to the cam portion 36. A first pattern device contains essentially the ground-thread guide 38, a cam part 42 for the butts 15 of the selection pushers 5, a cam part 43 with a clearance 44, formed in it, for the butts 12 of the needles 4, two selection devices 17*a* and 17*b* are arranged one behind the other in the running direction v and two offering cam-parts 45 and 46. This first pattern device serves the purpose of lifting the knitting needle 4 selectively into a knitting or tucking position, in which they pick up the ground thread 39 with their hooks 4*a,* or of leaving them in a non-knitting or run-through position, in which they do not pick up the ground thread 39. By contrast, the second pattern device contains essentially the plush-thread guide 40, a cam-part 47 for the butts 15 of the selection jacks 5, a cam-part 48 with a clearance 49, formed in it, for the buns 12 of the needles 4, a third selection device 17*c* and an offering cam-part 50. This second pattern device serves the purpose of lifting the knitting needles 4 selectively into a pick-up position, in which they pick up the plush thread 41 with the hooks 4*a,* or of leaving them in an intermediate position, in which they do not pick up the plush thread 41. The second pattern device lies preferably behind the first pattern device in the running direction v.

Furthermore, according to FIGS. 4 and 5, the knitting system contains a third pattern device assigned to the cam portion 37 and to the sinkers 25 and selection jacks 26. This pattern device has a cam-part 51 for the butts 29 of the selection pushers or jacks 26, a cam-part 52 with a clearance 53, formed in it, for the butts 27 of the sinkers 25, two fourth or fifth selection devices 33*a* and 33*b* arranged one behind the other in the running direction v, and two offering cam-parts 54 and 55. The third pattern device serves the purpose of controlling the sinkers 25 selectively into a first position intended for the formation of neutral plush-thread loops, a second position intended for the formation of long plush-thread loops and a third position intended for the formation of plush-thread loops of medium length.

The design and functioning of the selection devices 17*a*, 17*b*, 17*c* or 33*a*, 33*b* correspond essentially to those of the selection devices 17, 33 according to FIGS. 1 and 2. It is clear, in this case, that these selection devices are to allow an independent individual selection of the needles 4 or sinkers 25, and that consequently, in principle, instead of the selection devices 17, 33, any other electrical, electromagnetic or mechanical selection devices may also be used, in so far as these are likewise suitable for carrying out any desired selection of the needles 4 and sinkers 25.

The functioning of the circular knitting machine described may be gathered from FIGS. 3 to 5 and is essentially as follows.

As shown in FIG. 5, the knitting needles 4 run with their hooks 4*a* on a non-knitting track 57 into the cam portion 36. The associated selection jacks 5 are in this case in a selection position, into which they have been pivoted, counter to the pressure of the springs 16, with the aid of the offering cam-part 45 which is located at the start of the cam-part portion 36 (or at the end of the preceding cam-part portion). As a result, the selection jacks 5 are applied with an armature surface 5*a* (FIG. 3) to the first electromagnetic selection device 17*a* and are retained or released by the latter according to the pattern. The retained jacks 5 are located with their butts 15 outside the effective range of a drive-out edge 58 (FIG. 3) located on the cam-part 42, so that the hooks 4*a* of the associated needles 4 remain essentially in the non-knitting track 57 until the cam portion 36 is left. By contrast, the released jacks 5 are pivoted by the springs 16 into the position evident from FIG. 1, with the result that they come into the region of the drive-out edge 58 of the cam part 42 and are lifted by this edge into a tucking position 59 (FIG. 3). In this case, they are laid with their butts 14 against the needles 4 which are located above them and the butts 12 of which the in the clearance 44 (FIG. 3), and lift these needles 4, so that their hooks 4*a* enter a tucking track 60 (FIG. 5). With the aid of the offering cam-part 46 (FIG. 3), the selection jacks 5 are then pivoted into the groove of the needle cylinder 1 and are selected once again by means of the second selection device 17*b*. The jacks retained by the selection device 17*b* remain initially in the tucking position, and the hooks 4*a* of the associated knitting needles 4 remain correspondingly in the tucking track 60. By contrast, the butts 15 of the selection jacks 5 not retained by the second selection device come into the effective range of a further drive-out edge 61 (FIG. 3) of the cam-part 42 and are lifted by the said drive-out edge into knitting position 62. The associated needles 4, the butts 12 of which continue to lie in the clearance 44, are likewise lifted, so that their hooks 4*a* run through a knitting track 63 (FIG. 5), before the needles 4, due to the fact that the butts 12 thereof are drawn down of these are taken up by a lower edge 64 of the cam-part 48, arrive at the level of the tucking track 60 again and then, when they run further on, are drawn down into an intermediate position or intermediate track 65 (FIG. 5).

The needles 4 running through the tucking track 60 and the knitting track 63 pick up with their hooks 4*a* in each case the ground thread 39, whereas the latter is floated behind the needles 4 running through the non-knitting track 57. As a result, with the aid of the first pattern device, it is possible, by a three-way technique, to select the knitting needles 4 at the feeder 38 for the ground thread 39 selectively for knitting or non-knitting or for the formation of tuck stitches in accordance with any desired knitted pattern.

The selection jacks 5 lifted in the region of the first pattern device are drawn down, directly after the knitting position 62 is reached, into a lower position by means of a lower edge 66, acting on their butts 14, of a cam-part 67 and are then pivoted by means of the offering cam-part 50 into their selection position, in which they are fed to the third selection device 17*c*. The selection jacks 5 retained by the latter remain initially in this position, whilst the butts 15 of the released selection jacks 5 come into the region of a drive-out edge 68 (FIG. 3) of the cam-part 47 and are lifted once again in order, in a similar way to the above description, to raise associated knitting needles 4 into a pick-up position. The hooks 4*a* of these needles 4 therefore run through a pick-up track 69 (FIG. 5), whilst the hooks 4*a* of the remaining needles 4 run through a non-pick-up track 70 remaining essentially level with the intermediate track 65. The driven-out needles 4 consequently pick up the plush thread 41 with their hooks 4*a*, whilst the needles 4 remaining in the non-pick-up track 70 float the plush thread 41. It is therefore possible, with the third selection device 17*c*, selectively to insert the plush thread 41 in selected needles 4 or form plush-thread floats behind the remaining needles 4.

Behind the plush-thread guide 40, the butts 12 of the knitting needles 4 come on to a drawing-down or coulier edge 71 which is provided on the cam-part 48 and from which all the needles are taken down into a knock-over position which is indicated in FIG. 5 by a descending track portion 72. As a result, irrespective of the position of the associated sinkers 25 which is selected in the individual case, a stitch or tuck stitch is formed by means of those needles 4 into which a ground thread 39 and additionally a plush thread 41 have been inserted.

The fourth and fifth selection devices 33*a*, 33*b* (FIG. 4) operate in a similar way to the above-described operating mode of the selection devices 17*a* to 17*c*, but, in principle, completely independently of these. During the run into the cam portion 37, first all the sinkers 25 located in the hold-down position are pushed radially outwards, opposite to the arrow x, by means of an edge 74 of the cam-part 52, in order to provide space for the ground-thread guide 38, the top-lying plush-forming edges 25*d* following a track 75 indicated in FIG. 5 by an unbroken line, and the bottom-lying plush-forming edges 25*c* following essentially a track 76 indicated in FIG. 5 by a broken line, until both reach a position 75*a* and 76*a* respectively.

The associated selection jacks 26 are then brought into a selection position by means of the offering cam-part 54 and are then retained or released according to the pattern by the fourth selection device 33*a*. The retained selection jacks 26 remain in their position, so that the high sinker edges 25*d* of the sinkers 25 which are assigned to them and the butts 27 of which move in the clearance 53, come into a first track 77, along which they are initially pushed forwards only a little in the direction of the arrow x (FIG. 3). By contrast, the butts 29 of the released selection pushers 26 run onto a drive-out edge 78 of the cam-part 51, with the result that the associated sinkers 25 are pushed forwards to a greater extent in the direction of the arrow x. Consequently, the high sinker edges 25*d* are controlled into a second track 79 and, correspondingly, the lower sinker edges 25*c* into a portion 76*b* of the track 76. Finally, with the aid of the fifth selection device 33*b* operating in a similar way, the sinker edges 25*d* running along the first track 77 can be controlled in such a way that the sinker edges 25*d* selectively remain in the first track 77 or are fed into a third track 80 in which they are pushed forwards in the direction of the arrow x to a lesser extent than in the second track 79. This is achieved by means of a drive-out edge 81 of the cam-part 51 for the selection jacks 26, since this drive-out edge 81 rises to a lesser height than the drive-out edge 78 in the region of the fourth selection device 33*a*. Finally, behind the track portion 72 of the hooks 4*a* of the needles 4 in the running direction, all the sinkers 25 are brought into their hold-down position again by means of a drive-out edge 82, acting on their butts 27, of the cam-part 52, whilst the selection jacks 26 are retracted into their basic position by means of a drawing-back edge 83, acting on the butts 28, of the cam-part 52.

The tracks 77, 79 and 80 are designed in such a way that, starting from the fully retracted position 75*a* or 76*a*, the sinkers 25 are pushed forwards to a different extent in the region of the take-up track 72. In the first track 77, the sinkers 25 are pushed forwards only a little and only the knock-over edges 25*a* are used for the stitch forming operation, that is to say the ground and also the plush threads 39, 41 are formed into loops via the knock-over edges 25*a* only. This means that a two-thread double stitch is formed, and no plush loops projecting beyond the fabric top side are obtained. By contrast, in the second track 79, the sinkers 25 are pushed forwards to the greatest extent and in such a way that the ground threads 39 are again formed into loops via the knock-over edges 25*a* whereas the plush threads are drawn over the high sinker edges 25*d* and are thereby provided with long plush loops. Finally, when the sinkers 25 are steered into the third track 80, the ground threads 39 are again formed into stitches via the knock-over edges 25*a*, whilst medium-length loops are formed with the plush threads 41 by means of the lower sinker edges 25*c*. The length of the shorter or longer loops may in this case be determined by the distance of the edges 25*c*, 25*d* from the knock-over edge 25*a*.

The third pattern device serves the purpose of forming selectively short, long or even no plush loops. In conjunction with the first and the second pattern device, therefore, it is possible, for example, to have the controls indicated in FIGS. 6 to 12 for the needles 4 and sinkers 25.

Figure 6:
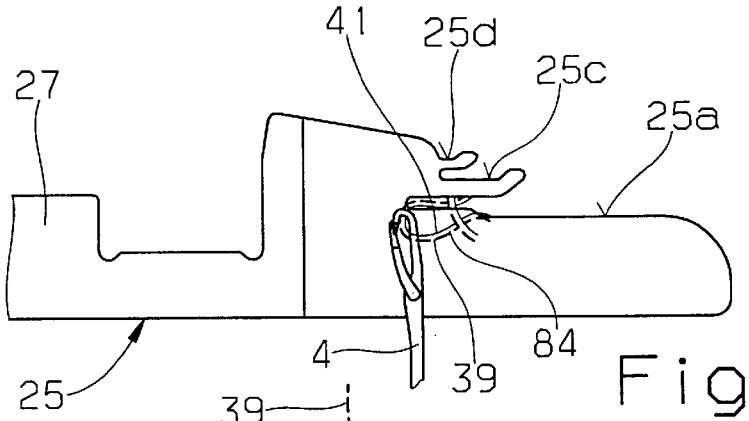
FIGS. 6 to 12 show diagrammatic and enlarged sections through knitting needles and sinkers assigned to one another, approximately in the region of the sectional lines VI—VI, VII—VII, VIII—VIII and X—X of FIG. 5, to illustrate various possible needle and sinker positions, with needles and sinkers greatly enlarged in relation to FIGS. 1 to 4.

FIG. 6 shows a section approximately along the line VI—VI of FIG. 5. The sinkers 25 are accordingly in the hold-down position pushed furthest forwards. Stitches 84, which have been formed in a preceding knitting system by means of the ground thread 39, illustrated by broken lines in FIG. 5, and the plush thread 41, designated by an unbroken line, are held in still closed hooks 4*a* of associated needles 4 and are held down by the action of the hold-down throats 25*b*.

Figure 7:
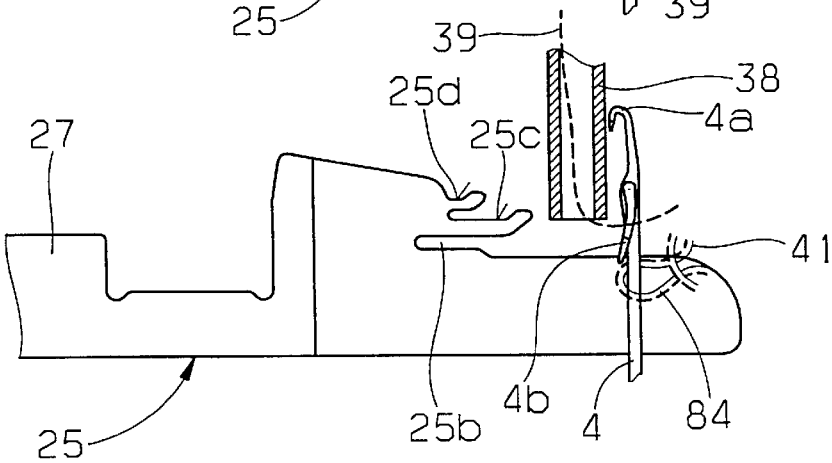

FIG. 7 shows the ground-thread guide 38 located in the region of the sectional line VII—VII of FIG. 5 and a fully driven-out needle 4, the hook 4*a* of which is moved along the track 63. The old stitch 84 has opened the latch 4*b* and has slipped under the latter onto the needle shank. During the subsequent take-down of the needle 4, the ground thread 39 is inserted into the open hook 4*a*.

Figure 8:
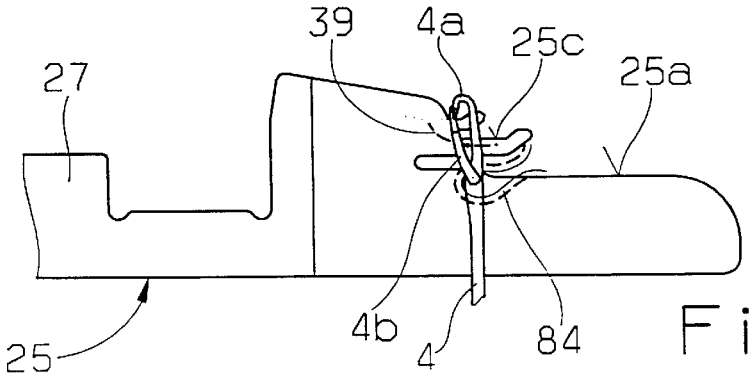
Figure 9:
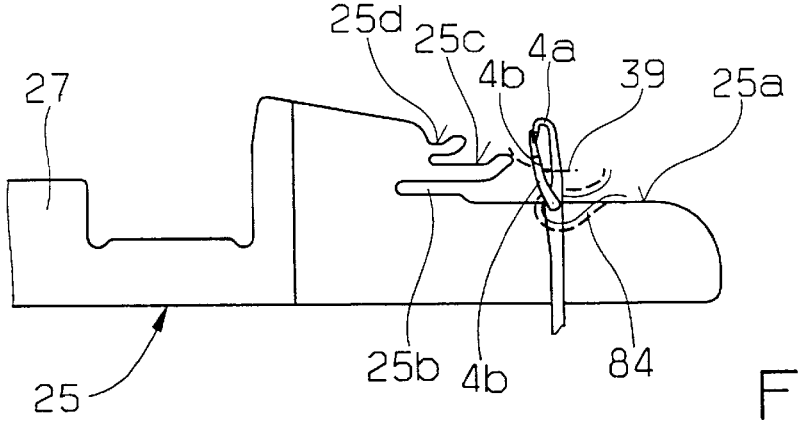

FIGS. 8 and 9 show diagrammatic sections along the line VIII—VIII of FIG. 5. In this case, FIG. 8 illustrates a sinker 25, the plush-forming edge 25*d* of which moves along the second track 79 in FIG. 5, whilst FIG. 9 shows a sinker 25 which is moved along the first track 77 and, in comparison with the sinker 25 according to FIG. 8, is pushed much less further forwards radially. In FIG. 8, the sinker edge 25*d* is located radially approximately level with an associated needle 4. Consequently, if a plush thread 41 were inserted in its hook 4*a* at the thread guide 40, long plush-thread loops would be formed from this thread 41 via the edge 25*d*. If, by contrast, a plush thread 41 were inserted into a needle 4 in the position evident from FIG. 9, then only very short plush-thread loops, designated here as neutral loops or "no loops", could be formed from this plush thread with the aid of the conventional knock-over edge 25*a*. Moreover, FIGS. 8 and 9 show that a ground thread 39 has already been inserted into the needle 4 and the needle latch 4*b* has been closed again by the old stitch 84. However, the old stitch 84 is still located on the latch 4*b*, that is to say the new ground thread 39 has not yet been formed through the old stitch 84 into a new stitch. Furthermore, FIGS. 8 and 9 show that the hook 4*a* is located approximately at a height corresponding to the tracks 65, 70 in FIG. 5. The already closed latch 4*b* thus ensures that a needle 4 running through the non-pick-up track 70 reliably cannot pick up a plush thread 41.

Figure 10:
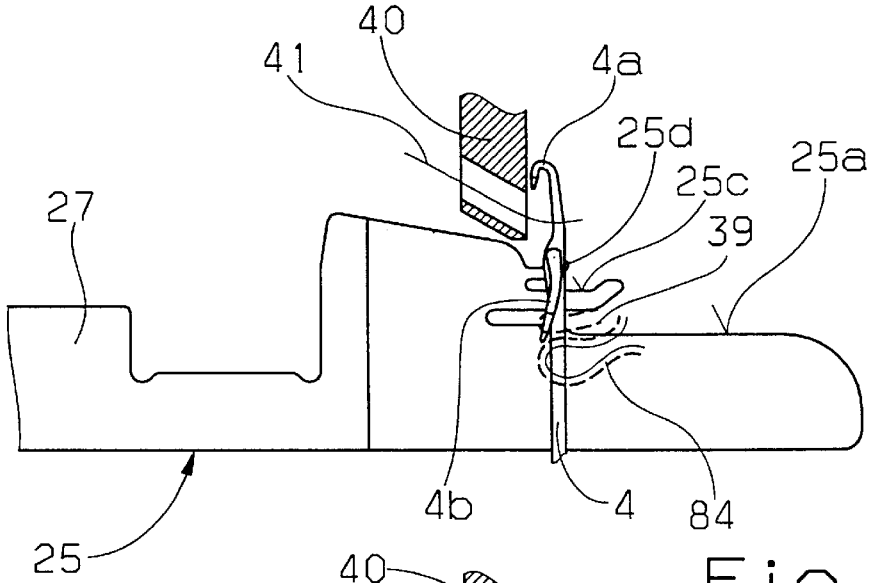
Figure 11:
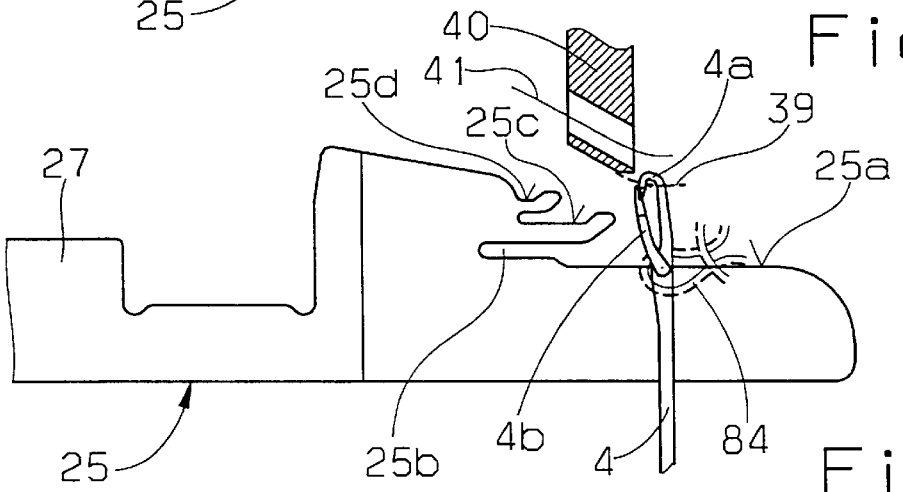
Figure 12:
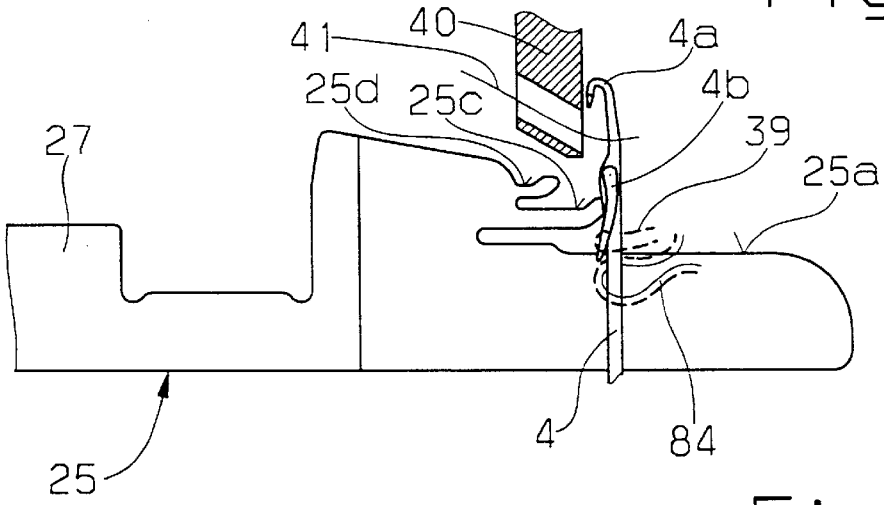

FIGS. 10 to 12 shows sections along a sectional line X—X of FIG. 5 for three different patterning possibilities.

In FIG. 10, a ground thread 39 has been inserted into the knitting needle 4 at the ground-thread guide 38. Subsequently, the needle 4 has been controlled into the pick-up track 69, with the result that the newly inserted ground thread 39 has opened the latch 4*b* again. Consequently, by means of the thread guide 40, a plush thread 41 can then be inserted into the open needle hook 4*a* and is knitted, in the region of the track 72, together with the ground thread 39 to form a stitch. The associated sinker. 25 is located, here, in a fully pushed-forward position according to the second track 79 in FIG. 5, so that a long plush loop is formed from the plush thread 41 via the highest sinker edge 25*d* during the lowering of the associated needle 4.

In the example according to FIG. 11, the needle 4 is in the intermediate position corresponding to the non-pick-up track 70 in FIG. 5. Only the ground thread 39 is located in the closed needle hook 4*a*. Since the needle 4 is not lifted along the pick-up track 59 and its latch 4*b* is closed, it does not pick up the plush thread 41, so that the latter is floated. For the sake of simplicity, the associated sinker 25 is shown in its fully retracted position, so that the plush-thread floats are formed via the Imock-over edge 25*a*, are kept very short and are therefore not cut off during a subsequent shearing operation. Alternatively, however, in this patterning possibility, the sinker 25 may also be located in the fully pushed-forward position according to FIG. 8, so that the float formed from the plush thread 41 is formed via the highest plush-forming edge 25*d* and is therefore grasped, cut and removed during a subsequent shearing operation.

Finally, FIG. 12 shows a needle and sinker position which differs from that according to FIG. 10 only in that the associated sinker 25 has been directed into a middle position corresponding to the third track 80 in FIG. 5. Consequently, here too, the plush thread 41 is inserted into the open needle hook 4*a*, but, when the needle 4 is drawn down into the knock-over position, the plush thread 41 comes to lie on the medium-height sinker edge 25*c*, so that plush loops of medium height are formed.

Figure 15:
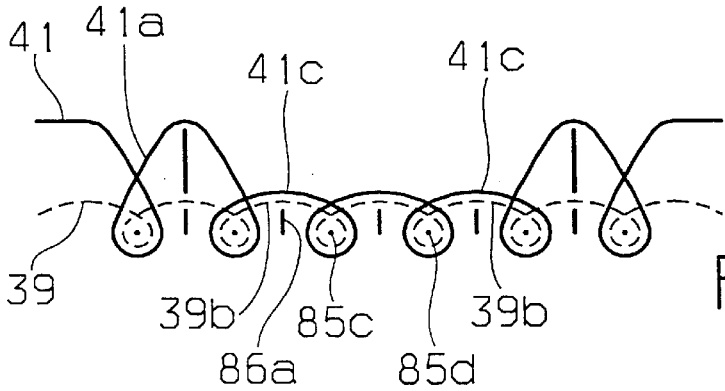
Figure 16:
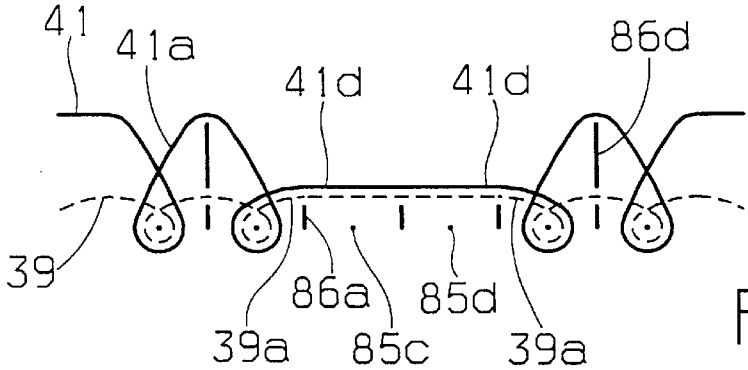
Figure 17:
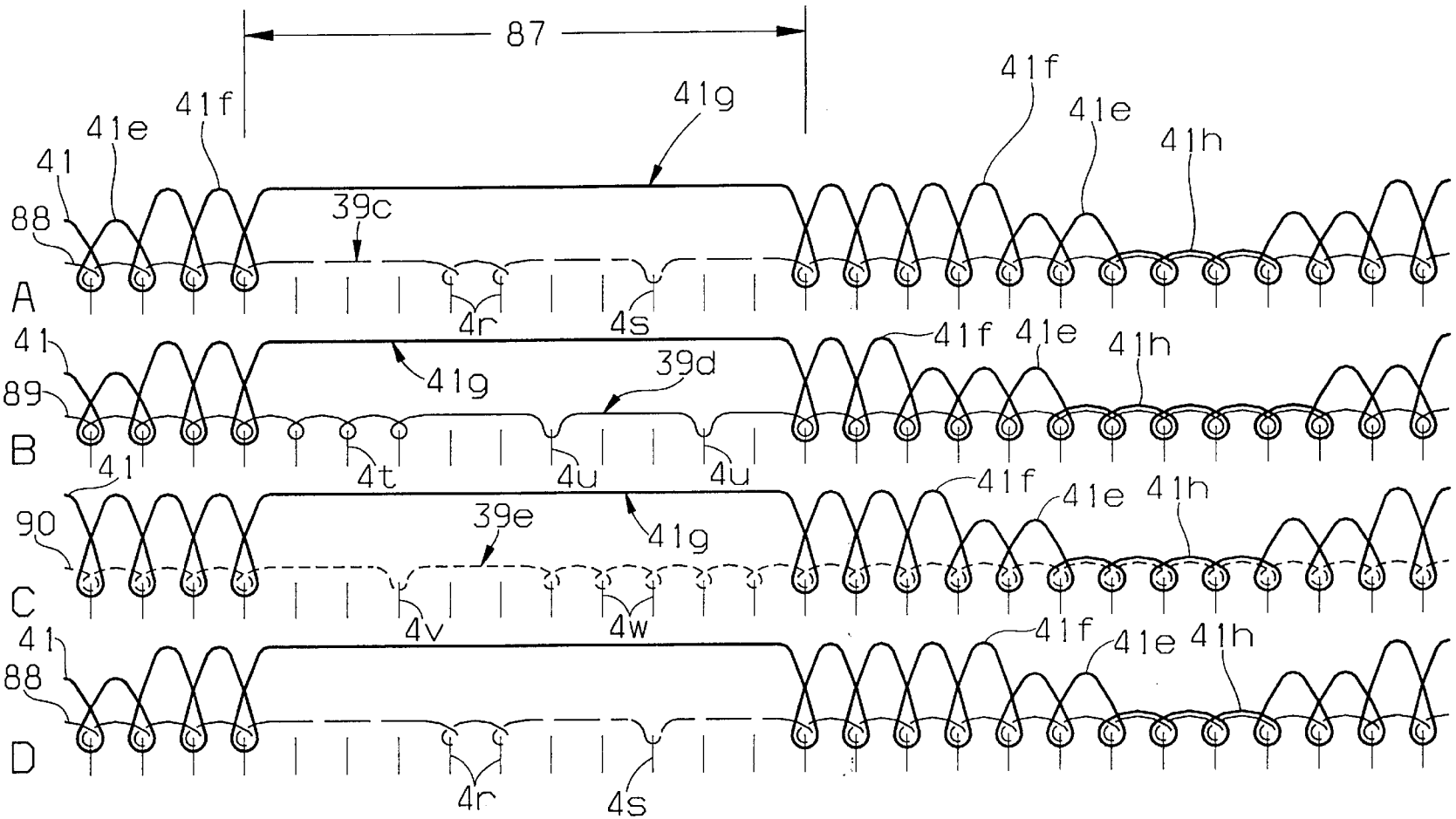
Figure 18:
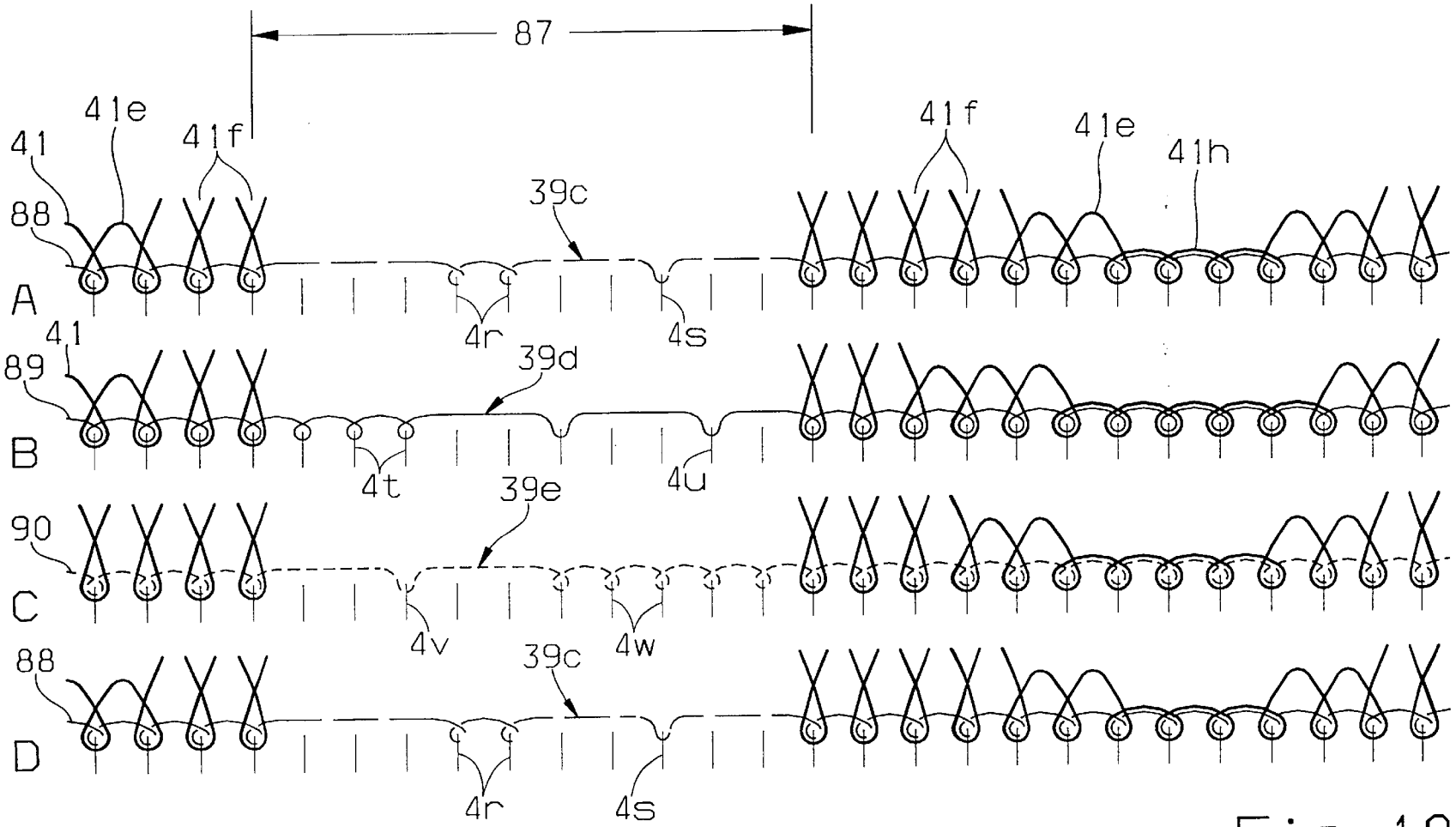

Knitting patterns capable of being produced by means of the circular knitting machine according to FIGS. 1 to 12 are illustrated in FIGS. 13 to 16 by means of one stitch row each and in FIGS. 17 and 18 by means of four stitch rows each. The knitting needles 85 are illustrated by dots and sinkers 86 by lines 86*a* and 86*d* of different height, which are intended to indicate the effective sinker edges 25*a*, 25*c* and 25*d* of different height in FIG. 5. Moreover, identical parts are given the same reference symbols here.

Figure 13:
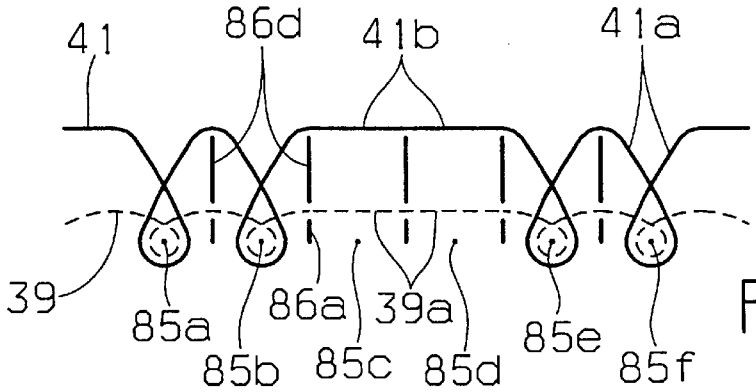
FIGS. 13 to 18 show examples of plush fabrics capable of being produced by means of the circular knitting machine according to FIGS. 1 to 12.

In FIG. 13, two needles 85*a*, 85*b*, 85*e* and 85*f* lying at the edges form in each case a double stitch from the ground thread 39 and the plush thread 41, the plush thread 41 being laid over high sinker edges 86*d* and therefore long plush-thread loops 41*a* being obtained. Lying inbetween are two needles 85*c* and 85*d*, in which the ground thread 39 forms floats 39*a* via the knock-over edges 86*a* and the plush thread 41 forms long floats 41*b*, corresponding to the second track 79 in FIG. 5, via high sinker edges 86*d*. During a subsequent shearing operation, only the floats 41*b* are removed, so that loop-free zones are obtained, in which the floating ground thread 39 is visible. Moreover, the long plush-thread loops 41*a* are cut open.

Figure 14:
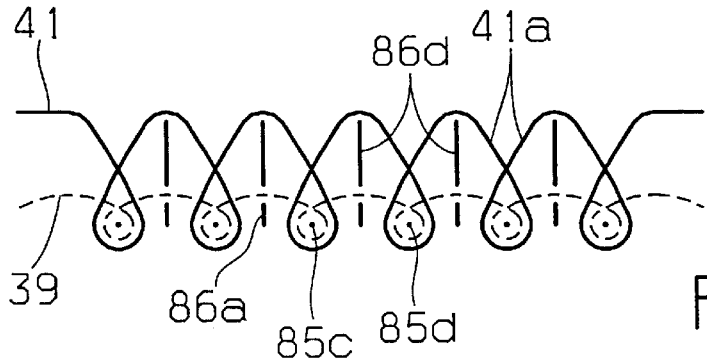

FIG. 14 shows a stitch row, in which the needles 85*c* and 85*d* in each case form a double stitch by means of the ground and the plush thread 39, 41. The plush threads 41 are drawn into long plush-thread loops 41*a* by the high plush edges 86*d*. What is obtained here, on all the needles, is a full plush fabric, the loops 41*a* of which are cut open during the shearing operation.

The stitch image according to FIG. 15 differs from that according to FIG. 14 in that, here, double stitches are formed from the ground thread 39 and the plush thread 41 at the needles 85*c*, 85*d* by means of the low-lying knock-over edges 86*a*. As a result, therefore, very short plush loops 41*c* are obtained which have the same length as the loops 39*b* of the sinker stitches formed from the ground thread 39 and which therefore do not project beyond the fabric surface. These loops 41*c* are the plush-thread loops designated as "neutral loops" within the scope of the present invention. In the finished fabric, therefore, the regions free of the plush loops 41*a* and formed on the needles 85*c*, 85*d* are determined, assuming correct plating, by the properties of the plush threads 41 used for forming the neutral loops 41*c*.

FIG. 16 shows, in a similar way to FIG. 15, a region which lies between two plush surfaces, is formed by the needles 85*c*, 85*d* and is determined by the properties of the plush threads 41. In contrast to FIG. 13, here, both the ground thread 39 and the plush thread 41 form floats 39*a* and 41*b* via the needles 85*c* and 85*d*. Since the two floats 39*a*, 41*d* are formed here with the aid of the knock-over edges 86*a* of the sinkers 86 and therefore lie flat against the fabric, they are not grasped or removed during any shearing operation.

FIGS. 17 and 18 show, finally, four stitch rows A to D of a further plush fabric which can be produced by means of the circular knitting machine described. In this case, FIG. 17 illustrates the still uncut fabric and FIG. 18 the cut plush fabric. In the stitch row A, four double-thread stitches are formed in the first four needles counting from the left, by a plush thread 41 being formed into medium or long loops 41*e* or 41*f* via the medium plush-forming edges 25*c* or the high plush-forming edges 25*d* of the sinkers 25. At the next ten needles which generate a region 87 free of plush loops, the plush thread 41 forms a float 41*g* via the high plush edges 25*d* of the associated sinkers 25. A first ground thread 88 forms a float 39*c* via the knock-over edges 25*a* of the same sinkers 25. So that this float 39*c* does not become too long, a stitch is formed by means of two needles 4*r* and a tuck stitch is formed by means of a further needle 4*s* with the ground thread 38. Finally, by means of the next teen needles 4, further longer and shorter plush loops 41*f* and 41*e* and additionally neutral loops 41*h* are formed according to the pattern, whilst, here, the ground thread is processed smooth right/left, i.e. in a plain manner.

The stitch row B differs from the stitch row A in the middle region 87 defined by the float 41*g* of the plush thread 41, in that a second ground thread 89 is processed into stitches by means of three needles 4*t* and into tuck stitches by means of two further needles 4*u* and is otherwise floated (floats 39*d*). On the remaining needles, a plain right/left ground knit with plush loops 41*e,* 41*f* and 41*h* of different lengths according to the pattern is produced.

In stitch row C, a third ground thread 90 is fed, which in the middle region 87 forms floats 39*e* which are tied into the ground knit by needles 4*v* or 4*w* by means of tuck stitches or stitches. In the remaining regions, the plush thread 41 forms long, short and no or neutral loops 41*e,* 41*f* and 41*h*.

Finally, in the example, stitch row D is identical to stitch row A, again the ground thread 88 used there being processed. Further stitch rows, not illustrated, may follow. As shown in FIG. 18, after a shearing operation the high plush-thread floats 41*g* in the middle region 87 of the knitted fabric are no longer present. Moreover, the long plush-thread loops 41*f* are cut open, whilst the short loops 41*e* and the neutral loops 41*h* are uncut. This results, in the middle region 87 of the fabric free of plush loops, in a ground knit which, by means of the first pattern device, has stitches, tuck stitches and floats according to the knitted pattern in the manner of the three-way technique.

As FIGS. 17 and 18 also show and as is indicated by long broken, unbroken and short broken lines, coloured patterns may also be provided in the region 87 in addition to the weave pattern described, in that different colours are imparted to the ground threads 88 to 90 on successive systems, so that the region 87 acquires both a knitted and a coloured pattern which becomes visible because of the absence of plush threads between the plush zones.

In addition to the patterns described and illustrated in the drawings, numerous further patterns can be produced by means of the circular knitting machine according to the invention. For example, it may be gathered from FIGS. 17 and 18 that the stitch rows A, B and C constitute three partial rows within the region 87, the first partial row A possessing two ground-thread stitches 4*r,* the second partial row B three ground-thread stitches 4*t* and the third partial row C five ground-thread stitches 4*w* which are added together to form a three-coloured full row, as is generally customary in Jacquard knits. This Jacquard pattern could also be replaced, if required, by a pattern which is formed by three differently coloured plush threads, in that, according to FIGS. 15 and 16, in the region 87, double stitches are produced from one of the plush threads and the ground thread at the points of the stitches 4*r,* 4*t* and 4*w* or, only neutral loops are formed by means of the plush threads or plush-thread floats are laid over the knock-over edges 25*a* of the sinkers 25.

The invention thus makes it possible, without the exchange of cam-parts, to have numerous hitherto non-implementable knitted, coloured and structural patterns in a single plush fabric. It is particularly advantageous, at the same time, that zones free of plush loops can be produced selectively either by the formation of long plush-thread floats and a subsequent shearing process (FIG. 13) or by the plush loops being designated as "neutral loops" (FIG. 15) or by the formation of short plush-thread floats (FIG. 16).

The invention is not restricted to the exemplary embodiments described which may be modified in many ways. In the first place, in addition to other selection devices, cam-part arrangements other than those described may also be provided. It is clear, further, that one of the two fourth and fifth selection devices 33*a*, 33*b* described with reference to FIGS. 3 to 5 could also be dispensed with, in particular the selection device 33*b,* in which case only neutral loops and long loops could be formed by means of the plush threads. In addition, it would be possible to design the selection devices in such a way that only long and short plush-thread loops can be produced. Furthermore, it is possible to provide a multiplicity of identical systems of the type described on the circumference of the needle cylinder or alternately to provide the systems described and other systems, for example those which serve solely for the production of straightforward ground-thread stitch rows. Moreover, the needle cylinder 1 could be arranged in a stationary manner, in which case, inter alia, the cam box 9 and the thread guide ring 23 would have to be arranged rotatably. Finally, it goes without saying that the various features may also be used in combinations other than those illustrated and described.

It will be understood, that each of the elements described above, or two or more together, may also find a useful application in other types of constructions differing from the types described above.

While the invention has been illustrated and described as embodied in a circular knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Circular knitting machine for the production of plush fabrics which have a ground knit produced from ground threads (39) and plush threads (41) tied into said ground knit, comprising: a needle cylinder (1) with knitting needles (4) intended for stitch formation, a sinker ring (18) with sinkers (25) intended for the formation of plush-thread loops, and a plurality of knitting systems each having a means (71) for controlling said knitting needles (4) into a knock-over position after a pick-up said ground and/or said plush thread, wherein each of said knitting systems has, at a point located in front of said means (71) in the knitting direction, a first pattern device, provided with a ground-thread guide (38), for selectively controlling said knitting needles (4) into a knitting or tucking position intended for the pick-up of said ground thread (39) or a non-knitting position intended for the non-pick-up of said ground thread (39), a second pattern device, provided with a plush-thread guide (40), for selectively controlling said knitting needles (4) into a pick-up position intended for the pick-up of said plush thread (41) or an intermediate position intended for the non-pick-up of plush thread (41), and a third pattern device for selectively controlling said sinkers (25) at least into a first position intended for the formation of shorter plush-thread loops or a second position intended for the formation of longer plush-thread loops.

2. Circular knitting machine according to claim 1, wherein said sinkers (25) have first plush-forming edges (25*a*) intended for the joint formation of ground-thread loops and of said shorter plush-thread loops and second plush-forming edges (25*d*) intended for the formation of said longer plush-thread loops.

3. Circular knitting machine according to claim 2, wherein said second and third pattern device are assigned to one another in such a way that a selection "neutral plush-thread loops" can be achieved either by controlling said sinkers (25) into said first position and simultaneously controlling associated knitting needles (4) into said pick-up position or by controlling said sinkers (25) into said second position and simultaneously controlling associated knitting needles (4) into said intermediate position.

4. Circular knitting machine according to claim 1, wherein said first pattern device has a cam portion (36) being assigned to said knitting needles (4), having a knitting, a tucking and a non-knitting track (63, 60, 57), and being arranged for distributing said knitting needles (4) according to a pattern in such a way that said knitting needles (4) selectively run through said tucking or said knitting track (60, 63) and at the same time pick up said ground thread (39) or run through said non-knitting track (57) without picking up said ground thread (39).

5. Circular knitting machine according to claim 4, wherein said first pattern device has a first selection device (17*a*) for distributing said knitting needles (4) to said non-knitting track (57) and a drive-out track according to a pattern and a second selection device (17*b*) for distributing said knitting needles (4) running through said drive-out track to the tucking track (60) or said knitting track (63) according to the pattern.

6. Circular knitting machine according to claim 4 or 5, wherein said tucking track (60) and said knitting track (63) end at a level lying between said tacking track (60) and said non-knitting track (57), said level corresponding to said intermediate position (65).

7. Circular knitting machine according to claim 1, wherein said second pattern device is arranged in a first cam portion (56) and has a pick-up track (69) assigned to said knitting needles (4), a non-pick-up track (70) assigned to said knitting needles (4) and a third selection device (17*c*) for distributing said knitting needles (4) to said pick-up track (69) or said non-pick-up track (70) according to a pattern.

8. Circular knitting machine according to claim 7, wherein said pick-up track (69) and said non-pick-up track (70) are arranged behind said knitting or tucking track (63, 60) in a knitting direction and start and end at a level corresponding to said intermediate position (65).

9. Circular knitting machine according to claim 1, wherein said third pattern device has a cam portion (37) being assigned to said sinkers (25) and having a first track (77) leading into said first position and a second track (79) leading into said second position, and is set up for distributing said sinkers (25) to said first and second tracks (77, 79) according to a pattern.

10. Circular knitting machine according to claim 9, wherein said cam portion (37) assigned to said sinkers (25) has a third track (80) which leads into a third position intended for the formation of medium-length plush-thread loops, and wherein said third pattern device has a fourth and a fifth selection device (33*a*, 33*b*) for distributing said sinkers (25) to the first, second and third tracks (77, 79, 80) according to a pattern.

11. Circular knitting machine according to one of claim 1, 4 or 9, wherein said third pattern device is arranged between said first and said second pattern device in the knitting direction.

* * * * *